US007644530B2

(12) United States Patent
Scherpf

(10) Patent No.: US 7,644,530 B2
(45) Date of Patent: Jan. 12, 2010

(54) SIGHTING DEVICE FOR A FIREARM

(75) Inventor: Christian Scherpf, Obersfeld (DE)

(73) Assignee: Blaser Finanzholding GmbH, Isny im Allgau (DE)

( * ) Notice: Subject to any disclaimer, the term of this patent is extended or adjusted under 35 U.S.C. 154(b) by 357 days.

(21) Appl. No.: 11/128,131

(22) Filed: May 12, 2005

(65) Prior Publication Data

US 2005/0252065 A1 Nov. 17, 2005

(30) Foreign Application Priority Data

May 13, 2004 (DE) ..... 10 2004 023 556

(51) Int. Cl.
*F41G 1/00* (2006.01)

(52) U.S. Cl. ..... 42/117

(58) Field of Classification Search ..... 42/111, 42/123, 131, 132, 145, 146, 117; 200/237
See application file for complete search history.

(56) References Cited

U.S. PATENT DOCUMENTS 1,993,979 A * 3/1935 Reed ..... 362/113
3,739,167 A * 6/1973 Avery ..... 362/157
3,892,082 A * 7/1975 Domhan ..... 42/11
4,079,534 A 3/1978 Snyder
4,152,754 A * 5/1979 deFilippis et al. ..... 362/113
4,162,521 A 7/1979 Snyder
4,168,588 A * 9/1979 Snyder ..... 42/115
4,275,521 A * 6/1981 Gerstenberger et al. ..... 42/84
4,295,289 A * 10/1981 Snyder ..... 42/114
4,313,273 A * 2/1982 Matthews et al. ..... 42/117
4,713,889 A * 12/1987 Santiago ..... 42/132
5,068,969 A 12/1991 Siebert
5,237,773 A 8/1993 Claridge
5,465,518 A * 11/1995 Blaser ..... 42/70.08
5,522,167 A 6/1996 Teetzel
5,706,600 A * 1/1998 Toole et al. ..... 42/115

(Continued)

FOREIGN PATENT DOCUMENTS

DE 298 02 904 U1 9/1998

(Continued)

*Primary Examiner*—Troy Chambers
(74) *Attorney, Agent, or Firm*—Martin Fleit; Paul D. Bianco; Fleit Gibbons Gutman Bongini & Bianco PL

(57) ABSTRACT

For a firearm sighting device with an electrical illumination device that can be turned on and off by means of a switch, the switch is embodied and arranged in or on the sighting device such that, for the conventional attachment of the sighting device on the firearm, the switch is activated mechanically to turn on the illumination device by the activation of an actuator provided in or on the firearm for setting the firearm into the armed state. By disabling the firearm, the switch is activated mechanically to turn off the illumination device. Preferably, the activation of the switch is performed using a non-contact method, for which, in particular, the configuration of the switch as a reed contact is suitable. The switch can also be part of a retrofit kit, by means of which a sighting device for a firearm can be equipped at a later time with the previously mentioned function. Here, the switch of the retrofit kit replaces a standard switch operated by hand separately from the firearm.

7 Claims, 3 Drawing Sheets

U.S. PATENT DOCUMENTS

| | | | | |
|---|---|---|---|---|
| 5,993,215 | A * | 11/1999 | Kotsiopoulos et al. | 434/21 |
| 6,219,952 | B1 * | 4/2001 | Mossberg et al. | 42/70.01 |
| 6,578,311 | B2 * | 6/2003 | Danielson et al. | 42/114 |
| 2002/0026741 | A1 * | 3/2002 | Aguilar | 42/146 |
| 2005/0155270 | A1 * | 7/2005 | Snyder | 42/114 |
| 2006/0026886 | A1 * | 2/2006 | Doukas | 42/117 |

FOREIGN PATENT DOCUMENTS

| | | | |
|---|---|---|---|
| DE | 199 13 461 | A1 | 8/1999 |
| DE | 199 60 420 | C1 | 12/2000 |
| EP | 0 018 769 | | 11/1980 |

* cited by examiner

SIGHTING DEVICE FOR A FIREARM

FIELD OF THE INVENTION

The invention relates to a sighting device for a firearm, i.e., a sighting device with an electrical illumination device which can be turned on and off by means of a switch. The invention also relates to a retrofit kit for a sighting device for a firearm.

BACKGROUND OF THE INVENTION

In modern telescopic hunting sights, there is a clear trend towards models with so-called illuminated reticles. In these configurations, a portion of the reticle, for example, the target point or the target circle, can be illuminated in order to increase the contrast of the reticle or a part of the reticle, according to its use. The energy source for the illuminated reticle is usually a battery located in the support of the illuminated reticle. Configurations found on the market are controlled on the device itself through a combination on/off switch and brightness controller. Such a sighting device is known from DE 199 13 461 A1, wherein the illumination device is in each case embodied as a retrofit kit for a conventional telescopic sight with a non-illuminated reticle.

To use a telescopic sight with an illuminated reticle while hunting, a hand must be taken from the hunting weapon before or after aiming in order to operate the device, i.e., to turn on the illumination and to regulate its brightness. On the one hand, this can cost precious seconds—for example, in pressure hunting situations—or can even be dangerous if the hunter forgets to turn on the device and then holds the armed weapon with one hand in order to turn on the illuminated reticle with the other hand. On the other hand, the devices are often turned on at the beginning of the actual hunt in order to avoid such problems. This consumes unnecessary energy since the illuminated reticle is needed only for the actual shot, and leads to the situation that the battery is often dead at the most important moment.

In view of these disadvantages of the state of the art, the invention is based on the problem of improving the operation of reticle illumination in terms of convenience and reliability in a sighting device with a reticle that can be illuminated electrically.

SUMMARY OF THE INVENTION

This problem is solved by a sighting device according to the present invention or by a retrofit kit for a sighting device according to the invention.

In a sighting device for a firearm with an illuminated reticle, the invention embodies the switch for turning on and off the illuminated reticle and arranges it in or on the sighting device such that, for the conventional attachment of the sighting device on the firearm, it is activated mechanically for turning on the illumination device by activation of an actuator provided in or on the firearm for setting the firearm into the armed state. On the one hand this configuration guarantees that the illuminated reticle is reliably turned on when the user unlocks the weapon for discharging a targeted shot. On the other hand, it eliminates the need to always keep the illuminated reticle turned on, since the hunter cannot forget to turn it on when aiming.

In this way, it is especially advantageous for the switch to also be embodied and arranged in or on the sighting device, such that for the conventional attachment of the sighting device on the firearm, it is activated mechanically for turning off the illumination device when the firearm is set to the unarmed state. Therefore, it is also unnecessary to manually turn off the illuminated reticle when abandoning an intended shot as well as after the discharge of one or more shots, as long as afterwards or by means of these actions the armed state is disabled.

It is especially useful for the switch to be activated using a non-contact method, since this particularly simplifies the production of an active connection between an actuator of the firearm and a switch arranged in or on the sighting device. Here, as a non-contact switch, a reed contact that can be closed by the force of a magnetic field comes primarily into consideration. As an alternative, however, it is also conceivable to use an electronic semiconductor switch that can be controlled by means of an optical, inductive, or capacitive proximity sensor, and an evaluation circuit associated with this sensor. In this case, however, a certain amount of power consumption by the evaluation circuit cannot be avoided. Such power consumption can be acceptable if it can be held very low in comparison with the power consumption of the light source. Furthermore, the principle according to the invention can basically also be implemented completely under the use of a conventional switch that can be activated by mechanical force transfer.

Because the actuators for enabling or disabling the armed state of a firearm are always arranged directly on the weapon itself, while the switch for turning on and off the illuminated reticle is preferably arranged in or on the sighting device, the switch or an activation element of this switch should be located, for a conventional attachment of the sighting device on the firearm, on the side of the sighting device that faces the firearm. This aids both a non-contact coupling and also a purely mechanical coupling to an actuator of said type on the weapon.

In addition to the form of a finished sighting device, the principle according to the invention can also be realized by a retrofit kit designed for a sighting device with an illuminated reticle, to replace a standard illuminated reticle on/off switch that is operated by hand separately from the firearm with a switch of the type mentioned above that is activated mechanically for turning on the illuminated reticle by an actuator provided in or on the firearm for setting the firearm into the armed state. By means of such a retrofit kit, the operation of the reticle illumination in high-quality sighting devices with illuminated reticles can be significantly improved in terms of convenience and reliability, at relatively low expense.

All of the possible and advantageous refinements for realizing the invention in the form of a manufactured sighting device are also possible and advantageous for their realization in the form of a retrofit kit.

BRIEF DESCRIPTION OF THE DRAWINGS

Preferred embodiments of the invention are described below with reference to the drawings. Shown in these are.

DETAILED DESCRIPTION OF THE INVENTION

Figure 1:
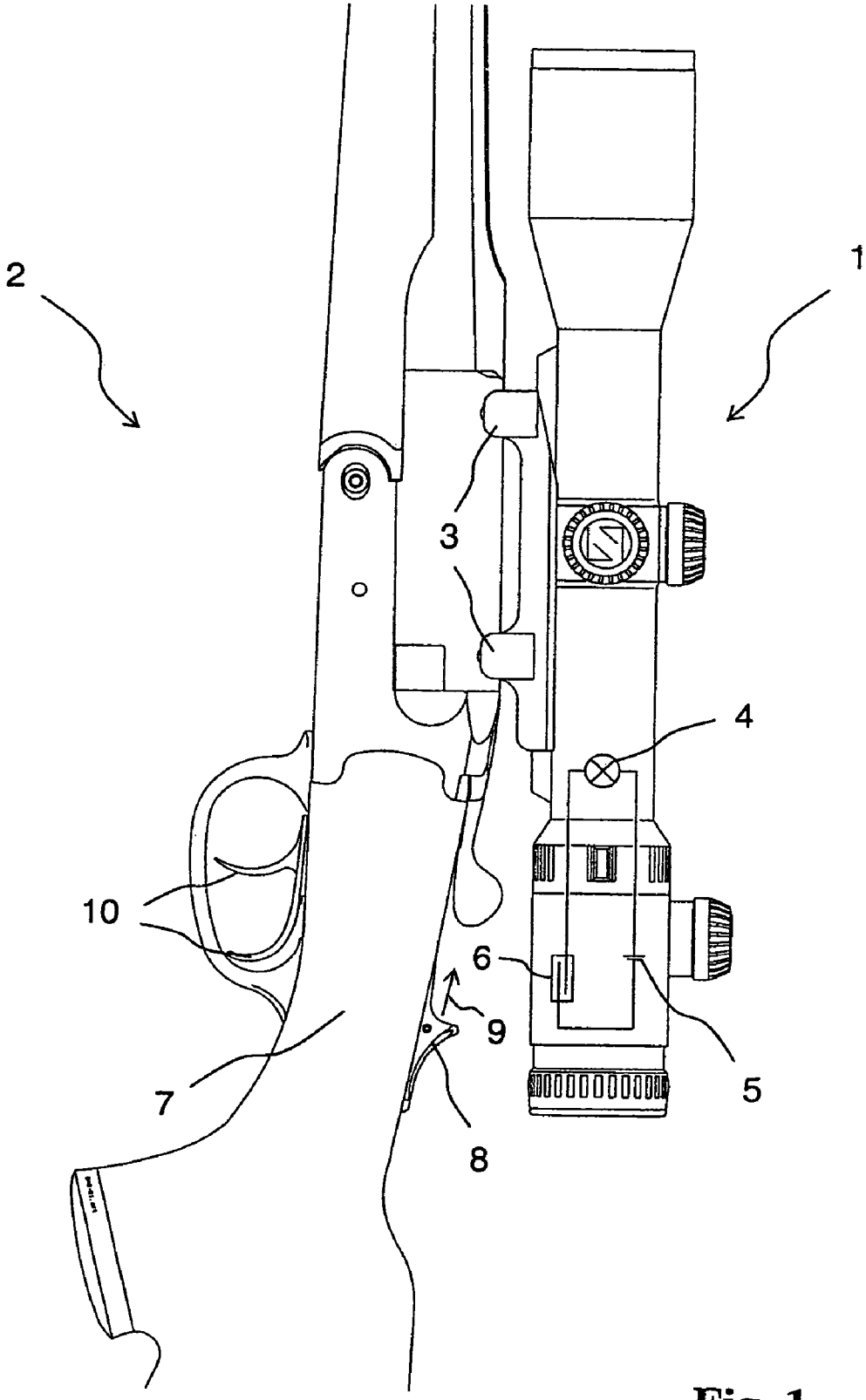
FIG. 1, a cut-away portion of a firearm equipped with a sighting device according to the invention, FIG. 2, a part of a sighting device equipped with a retrofit kit according to the invention, in the assembled state, and FIG. 3, an exploded view of the part of a retrofitted sighting device from FIG. 2, according to the invention.

FIG. 1 shows a sighting device 1 in the form of a telescopic sight, which is attached to a firearm 2 in the form of a shotgun by means of a mount 3 of a known type. The sighting device 1 contains a reticle, for example, in the form of crosshairs, which can be partially illuminated, for example, by a bright point in the center. This illumination is generated by a light source 4, which concerns a light-emitting diode (LED). Possibilities for optical superimposition of a light point at defined points in the field of view of a telescopic sight are known and not of interest here. A battery 5 is used for supplying power to the light source 4. A switch 6 in the form of a reed contact is connected in the power circuit for powering the light source 4 by the battery 5. All of the elements belonging to this power circuit are installed in or on the sighting device 1. It is understood that the representation of said power circuit in FIG. 1 is schematic.

A reed contact is an electrical switch which is composed of two electrically and magnetically conductive contact terminals, in a glass tube with protective gas filling, that can be brought into contact with each other by the generation of an external magnetic field, especially when a permanent magnet approaches, in order to close a power circuit. When the magnetic field is removed, the contact terminals move away from each other again and break the power circuit. Thus, a reed contact is a switch that can be activated using a non-contact method.

The firearm 2 has available a trigger mechanism whose spring can be cocked and uncocked by a so-called cocking slide 8 arranged on the top side of the stock 7. In the illustrated position, the trigger mechanism of the weapon 2 is uncocked and can be cocked by pushing the cocking slide 8 forwards in the direction of arrow 9. The cocking slide 8 then remains latched in its new position, but it can be released from this position in order to uncock the trigger mechanism of the weapon 2 and thus moves back into the illustrated position. Uncocking is also performed by discharging two shots by means of the double trigger lever 10, wherein obviously the principle can be applied just as well to a one-shot weapon.

As can be seen in FIG. 1, the cocking slide 8 approaches the switch 6 during the cocking motion. If this switch is a reed contact, then it can be closed by the approach of the cocking slide 8 if a permanent magnet of sufficient strength is mounted in or on the cocking slide 8 or if the cocking slide 8 is itself embodied at least partially as such a magnet. This has the result that, when cocking the trigger mechanism of the weapon 2, which absolutely must precede a shot, the switch 6 is closed and the light source 4 for illuminating the reticle is turned on. The user of the weapon 2 thus cannot forget to turn on the illumination, and the illuminated reticle is provided reliably when he is aiming. On the other hand, during a hunt the weapon 2 is armed only when discharging a shot is imminent, so that the illuminated reticle is not in operation unnecessarily over a long time.

By discharging a shot or by manually uncocking the weapon 2 when abandoning a shot, the cocking slide 8 moves away from the switch 6 again, whereby the power circuit of the light source 4 is broken. Thus, the hunter cannot forget to turn off the illumination of the reticle when it is no longer needed.

By no means must the previously explained interaction of the cocking slide 8 with the switch 6 be performed using a non-contact method. In fact, it is also conceivable that the switch 6 can be activated by mechanical force transfer, i.e., the switch is a conventional mechanical pushbutton which has an actuator in the form of a lever projecting down from the sighting device 1 into the path of motion of the cocking lever 8. Here the arrangement of the switch 6 in the longitudinal direction of the sighting device and the travel range of the lever must be adapted to the movement range of the cocking slide 8, so that the cocking slide 8, in the front end position latched for a cocked trigger mechanism, moves the lever of the button sufficiently far that the switch 6 in this case closes the power circuit to the light source 4.

Furthermore, the actuator of the firearm 2 that acts on the switch 6 does not absolutely have to be a cocking slide 8 of the previously explained type. For example, an actuator for a safety, which blocks the discharge of a shot for a cocked trigger mechanism, can have an active connection with the switch 6. Thus, such a safety actuator can be realized in the form of a flap that is arranged on the top side of the stock 7 under the switch 6, and that can rotate about an axis parallel to the barrel axis of the weapon. In the safety position, the flap lies flat on the top side of the stock 7 and in the unlocked position it projects upwards perpendicular from the stock 7 in the direction of the switch 6. It is clear that in this way both a non-contact, magnetic activation and also a conventional mechanical activation of the switch 6 can be implemented.

The preceding explanations with reference to FIG. 1 are generally valid for the combination of a sighting device 1 which has a reticle that can be illuminated, with a firearm 2. In this way, the light source 4, the battery 5, and the switch 6 that can be activated by an actuator of the weapon 2 can be integrated structurally into the sighting device 1 from the start, as drawn in FIG. 1. However, numerous high-quality sighting devices with reticles that can be illuminated are already in use, for which the illumination still must be turned on and off purely by hand, this being associated with the disadvantages listed in the introduction. There is thus a need to be able to retrofit such existing sighting devices in terms of their operation in the sense according to the invention. Herein is another aspect of the present invention, which will be discussed below with reference to FIGS. 2 and 3.

Figure 2:
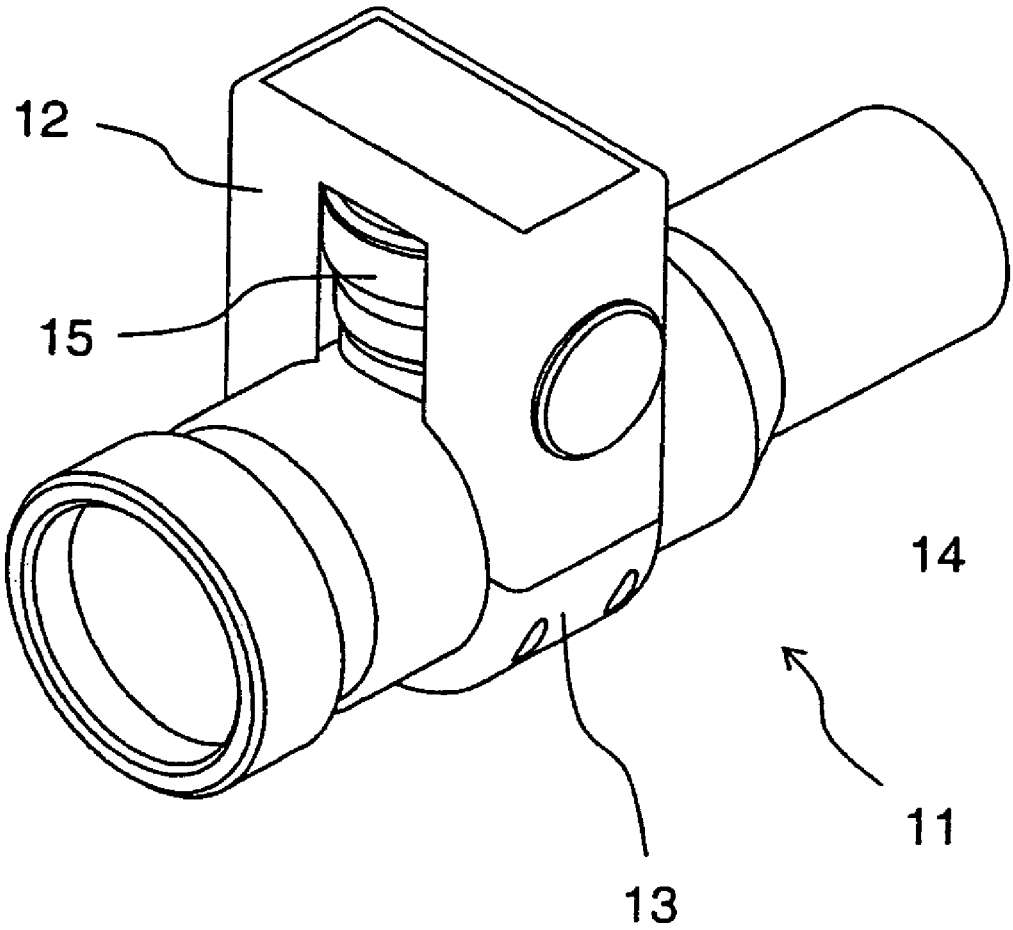

FIG. 2 shows a sighting device 11, in the form of a telescopic sight with an illuminated reticle, which has been modified by mounting a retrofit kit in the sense according to the invention. The retrofit kit has a housing, whose main components are a housing top part 12 and a housing bottom part 13, which in the assembled state surround a section of the cylindrical main housing 14 of the sighting device 11 in the region of a support 15 set onto this housing perpendicular to the axis. The battery for supplying power and also a rotary knob for turning on and off the illuminated reticle are housed in this support. When the sighting device 11 is retrofitted using the retrofit kit according to the invention, the battery and the rotary knob are removed and replaced by other components, which can be seen in detail from the exploded view in FIG. 3.

For the retrofitting, a contact ring 16 and a contact bolt 17 are inserted into the support 15, these being insulated from each other by an annular intermediate insulator 18. The contact ring 16 is also insulated by a similar annular outer insulator 19 from the support 15. On their bottom side the contact ring 16 and the contact bolt 17 each contact electrodes, which are connected within the main housing 14 to the two connections of a light source 4 for illuminating the reticle, which is not shown in FIG. 3, and which corresponds to FIG. 1. The housing top part 12 is provided with two contact electrodes which in the finished, assembled state, contact the contact ring 16 or the contact bolt 17 and thus enable a supply of power to the part of the power circuit within the main housing 14 for the illuminated reticle. These two contact electrodes are hidden in the representation of FIG. 3.

One of the two contact electrodes assigned to the contact ring 16 or the contact bolt 17 is connected directly to a contact electrode that contacts a pole of the battery 5 in the region of the battery compartment 20. The other of the two contact electrodes assigned to the contact ring 16 or to the contact bolt 17 is connected to a contact socket on the bottom side of the leg of the housing top part 12 opposite the battery compartment 20. An electrical connection from the other pole of the battery 5 leads to a second contact socket on the bottom side of the leg of the housing top part 12 in which the battery compartment 20 is located. The battery 5 corresponds to that of FIG. 1.

Figure 3:
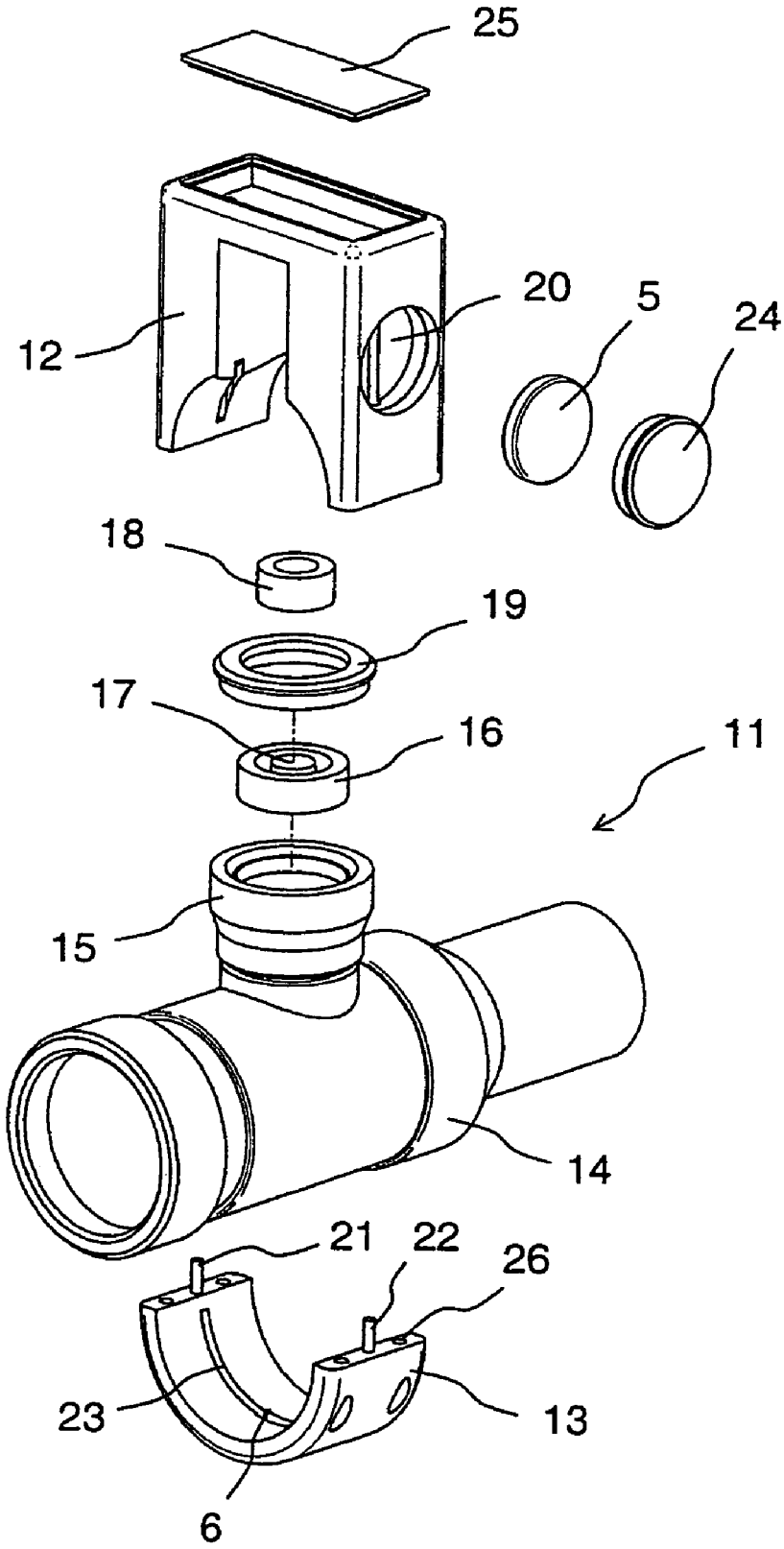

To form plug-in connections with the two contact sockets on the bottom sides of the two legs of the housing top part 12, which cannot be seen in FIG. 3, there are two contact pins 21 and 22 on the top side of the two legs of the housing bottom part 13. These two contact pins 21 and 22 are connected to the two connections of a switch 6, in the form of a reed contact, which is housed in a recess 23 in the housing bottom part 13 in the center of this part, i.e., at its lowest point. Altogether, a power circuit is thus created, in which the light source 4 (FIG. 1) of the illuminated reticle in the main housing 14, the battery 5, and the switch 6 are connected in series so that the illuminated reticle can be turned on and off by the switch 6. In this way, the two-sided cable routing in the housing parts 12 and 13 simplifies the intermediate connection of the switch 6 in the power circuit.

The battery compartment 20 is closed after inserting the battery 5 by means of a battery compartment cover 24. Furthermore, there is a housing cover 25 for closing the top side of the housing top part 12. For attachment to the housing top part 12, the housing bottom part 13 preferably has four holes 26 that in the assembled state align with threaded holes in the housing top part 12 to enable a screw connection between the two housing parts 12 and 13. In this way, the two housing parts 12 and 13 are also fixed to the main housing 14 of the sighting device 11.

By retrofitting with the help of the retrofit kit according to the invention, the illuminated reticle of the sighting device 11 is turned on only when it is actually needed, and this is realized by a hand action that must in any case be performed before discharging a shot. This configuration is associated with a long lifetime for the battery and also a gain in safety for handling the firearm shortly before discharging a shot. The retrofitting can be performed quickly and without disrupting the sensitive optics of a telescopic sight, and imparts to a sighting device with a standard manually-operated illuminated reticle the same advantages as those realized by implementing the present invention in the construction of a sighting device.

What is claimed is:

1. A combination of a firearm having a barrel and a firearm scope sight mounted on top of the barrel of the firearm, the combination comprising:

an illuminatable reticle contained within the firearm scope sight;

an electrical illumination device mounted on the firearm scope sight and operable to illuminate the reticle;

an actuator provided in or on the firearm, wherein said actuator is manually movable between two positions, a first position wherein the firearm is in an armed state capable of being fired, and a second position wherein the firearm is in an unarmed state not capable of being fired; and a switch mounted on the firearm scope sight in a location in relative proximity to the actuator and operably associated therewith such that when the actuator is moved to the first position the switch in response to movement of the actuator turns on the electrical illumination device to illuminate the reticle, and when the actuator is moved to the second position the switch in response to movement of the actuator turns off the electrical illumination device to cease illumination of the reticle.

2. The combination according to claim 1, wherein the switch is a reed contact capable of activation by force of a magnetic field supplied by movement of the actuator.

3. The combination according to claim 1, wherein the switch is an electronic semiconductor switch controllable by one of an optical, inductive, or capacitive proximity sensor and an evaluation circuit associated with the sensor.

4. The combination according to claim 1, wherein the switch is capable of activation by one of a magnetic and a mechanical force transfer supplied by movement of the actuator.

5. The combination according to claim 1, wherein the actuator is one of a cocking member for a trigger mechanism of the firearm and a safety for preventing discharge of the firearm.

6. The combination according to claim 1, wherein a switch is mounted on a retrofit housing that is mounted on the firearm scope sight.

7. The combination according to claim 1, wherein the switch mounted on the firearm scope sight is activated by movement of the actuator provided in or on the firearm.

* * * * *